US005332376A

United States Patent [19]

Lindbrandt

[11] Patent Number: 5,332,376

[45] Date of Patent: Jul. 26, 1994

[54] SCREW COMPRESSOR FOR INTERNAL COMBUSTION ENGINES

[75] Inventor: Benny Lindbrandt, Johanneshov, Sweden

[73] Assignee: Opcon Autorotor AB, Nacka, Sweden

[21] Appl. No.: 853,762

[22] PCT Filed: Dec. 2, 1990

[86] PCT No.: PCT/SE90/00864

§ 371 Date: Jun. 1, 1992

§ 102(e) Date: Jun. 1, 1992

[87] PCT Pub. No.: WO91/10045

PCT Pub. Date: Jul. 11, 1991

[30] Foreign Application Priority Data

Dec. 22, 1989 [SE] Sweden ..... 8904359

[51] Int. Cl.[5] ..... F01C 21/00

[52] U.S. Cl. ..... 418/179; 418/201.1; 403/334

[58] Field of Search ..... 418/179, 201.1; 403/333, 334

[56] References Cited

U.S. PATENT DOCUMENTS

| | | | |
|---|---|---|---|
| 1,567,073 | 12/1925 | Mocigemba | 418/201.1 |
| 3,057,543 | 10/1962 | Marsden | 418/201.1 |
| 4,648,817 | 3/1987 | Mariani | 418/152 |
| 4,711,006 | 12/1987 | Baldenko et al. | 403/333 |
| 4,846,642 | 7/1989 | Nuber et al. | 418/201.1 |

FOREIGN PATENT DOCUMENTS

| | | | |
|---|---|---|---|
| 453318 | 1/1988 | Sweden . | |
| 2185288 | 7/1987 | United Kingdom | 418/201.1 |

*Primary Examiner*—Richard A. Bertsch
*Assistant Examiner*—Charles G. Freay
*Attorney, Agent, or Firm*—Frishauf, Holtz, Goodman & Woodward

[57] ABSTRACT

A screw compressor, especially adapted for use as a supercharger for an internal combustion engine, comprises a housing having a barrel section (2) preferably made from aluminum and two end sections (3,4), in which housing a pair of screw rotors (7,8) are mounted. The end sections (3,4) are provided with projections (29) inserted into the end portions of the barrel section (2) by forced fit between surfaces (30,31) of the projections. The end portions of the barrel section and are also secured to the barrel section by screw joints.

16 Claims, 3 Drawing Sheets

SCREW COMPRESSOR FOR INTERNAL COMBUSTION ENGINES

BACKGROUND OF THE INVENTION

The present invention relates to a screw compressor, especially for use as a super-charger for an internal combustion engine.

Such a screw compressor comprises a housing, having a barrel section and two end sections, enclosing a working space provided with inlet and outlet ports and formed by two intersecting bores, and a pair of intermeshing rotors mounted in the housing, each rotor being provided with helical lands and intervening grooves.

A screw compressor according to the invention is an improvement to earlier used super-chargers, e.g. turbo chargers which give a poor efficiency especially at low speed of the engine. A compressor according to the invention may suitably be driven by the crank shaft of the engine through a belt drive, which means that independent of the number of revolutions, the compressor can always deliver a volume of air enough to fill the engine and having a pressure higher than atmospheric pressure. Such feeding of pressurized air to the engine results in a higher power delivered.

In a screw compressor it is essential that the barrel section and the end sections of the housing in mounted position has acceptable rigidity for the intermeshing rotors to act properly. Earlier known compressor housings have been produced from east iron, which results in a rather heavy compressor partly due to the high density of iron, and partly due to relatively thick walls. Such housing further requires a considerable mount of work to cut the housing to exact dimensions (measure deviation 0.03 to 0.05 mm). Screw compressor housings have also been east from aluminium. In order to obtain the necessary stability the barrel section and one end section are cast as one unit. This means complicated bottom hole manufacture and thick walls. All those compressors are thus relatively heavy and bulky and are thus unsuitable for mounting on the side of the engine.

The aim of the present invention is to avoid the disadvantages mentioned above and to obtain a number of advantages in comparison with the earlier known screw rotor super-chargers.

SUMMARY OF THE INVENTION

A screw compressor according to the invention comprises barrel section of a housing which is produced by extrusion from a suitable material, preferably light metal, especially aluminium, and where the end sections each are provided with a projection shaped correspondingly to the transverse section of the working space and inserted into the barrel section by forced fit. Such an extruded housing needs considerably less and simpler adjustment. On the whole the extruded casing results in lower production cost. Furthermore an extruded barrel section can be cut into different lengths in order to achieve different swept volumes when using the same end sections. However, such an extruded barrel section is comparatively weak and needs strengthenings to obtain the necessary rigidity. This rigidity is obtained by the interconnection under pressure between the barrel section and the end section projections.

The highest rigidity is obtained if the interconnected surfaces are cylindrical but it is also possible according to the invention that at least one of the interconnected surfaces is tapered.

In a preferred embodiment of a compressor according to the invention, the outlet port means is provided in a portion of the barrel section having a flat surface. This flat surface can be produced by the extrusion which means a minimum of adjustment. The outlet ports can be cut out to a shape and size adapted to the desired internal compression ratio of the compressor.

A preferred embodiment of the invention will now be described in connection with the drawings where:

DETAILED DESCRIPTION

Figure 3:
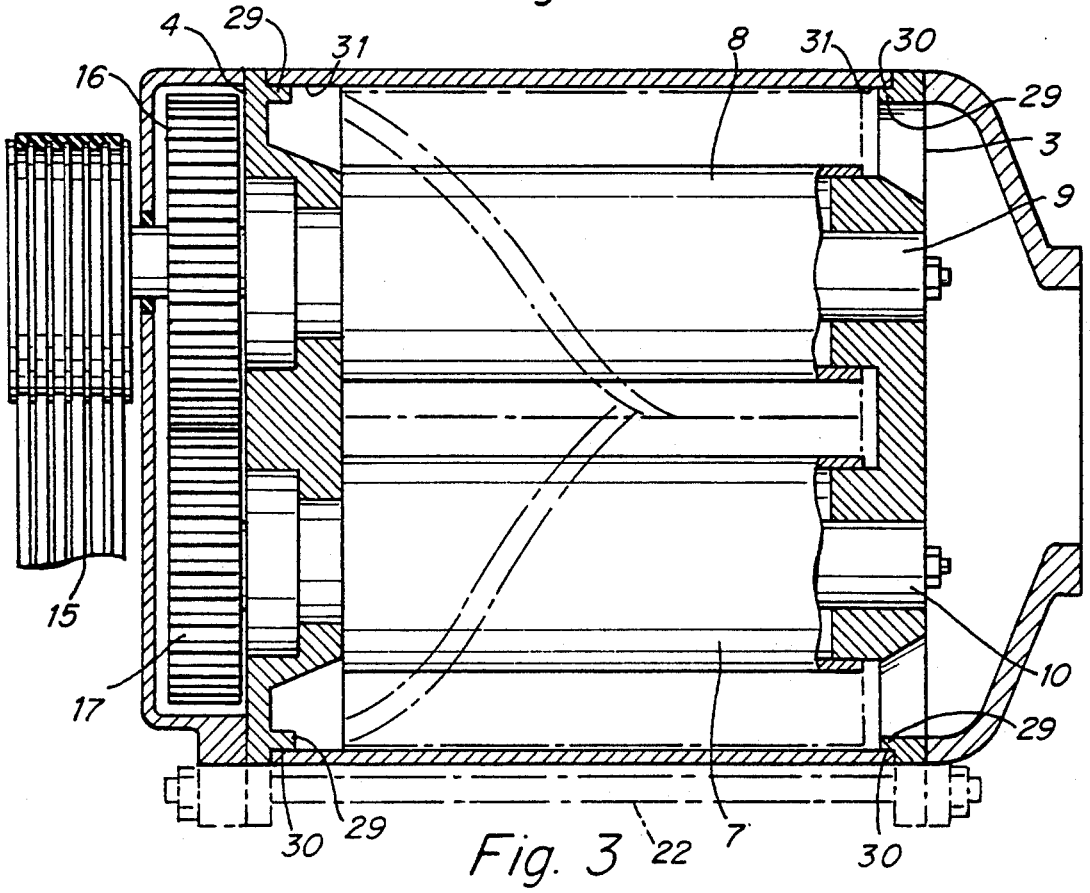

As shown in the drawings, the compressor comprises a housing 1, including a barrel section 2 and two end sections 3 and 4, respectively. The barrel section 2 comprises two bores 5 and 6, respectively, which intersect with each other. In the bores two rotors 7 and 8, respectively, are provided for rotation in opposite directions as the lands and grooves of the rotors intermesh within the intersecting portion of the bores 5, 6. The shafts 9, 10 of the rotors are mounted in the end sections 3, 4 in journals 11, 12 and 13, 14 (FIG. 1), respectively and the rotors are driven by belt 15 (FIG. 3 ), preferably from the crank shaft of the engine, and the drive is transferred to the rotors 7, 8 by gears 16 and 17, respectively.

Figure 1:
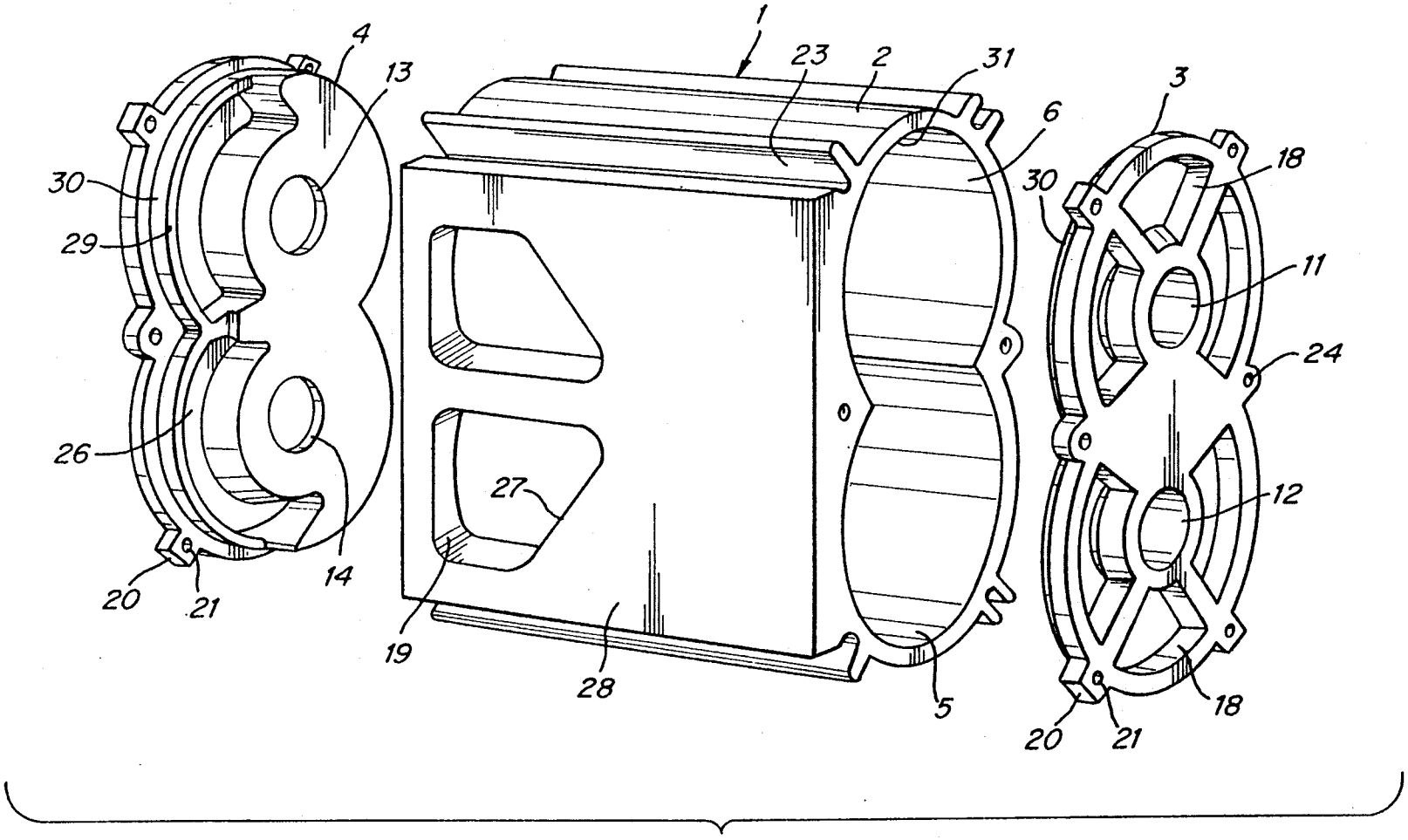
FIG. 1 shows a perspective view of a compressor housing, with a barrel section and end sections which are separated from each other.
Figure 2:
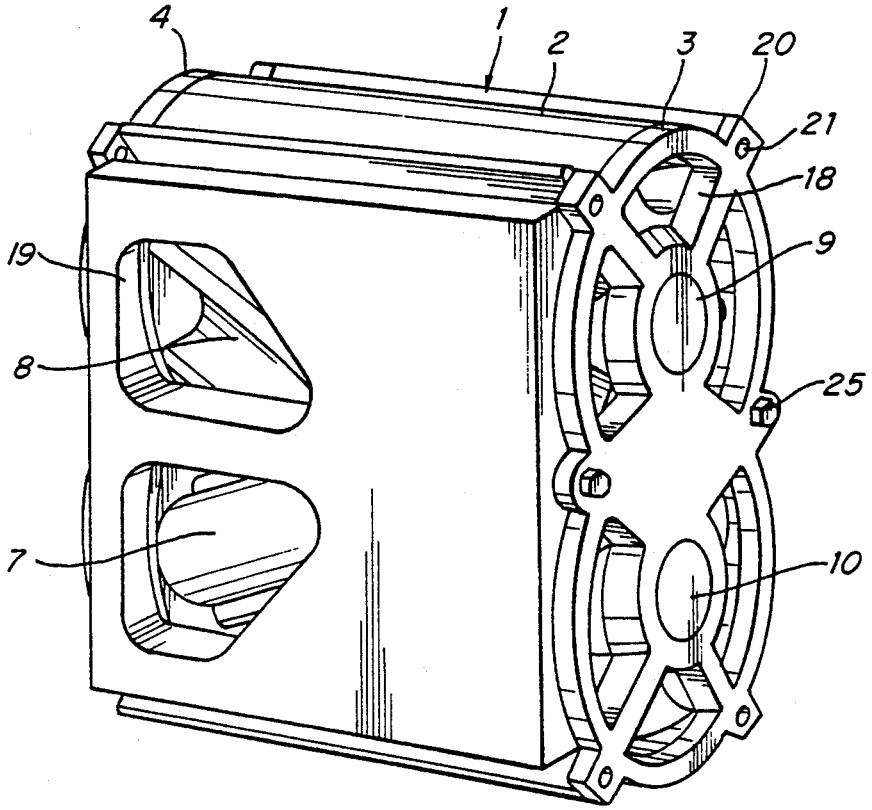
FIG. 2 shows a perspective view of a combined compressor and FIG. 3 shows a central longitudinal section through the compressor.

One end section 3 comprises three inlet openings 18 to each rotor for admittance of air and the barrel section 2 is provided with an outlet opening 19 for air from each rotor. Furthermore, each end section 3, 4 comprises radial projections 20 provided with holes 21 for bolts 22 to connect the barrel and end sections of the housing. The bolts pass through grooves 23 in the exterior of barrel section. The end sections 3, 4 are provided with holes 24 in their intermediate portions for screws 25 fixed in the barrel section. The end section 4 at the outlets 19 has cut away portions 26 to form channels to the outlet openings 19. As shown in FIG. 1 the edge 27 of the opening 19 which is remote from the end section 4 has an inclination direction substantially the same as that of the land of the cooperating rotor.

Figure 4:
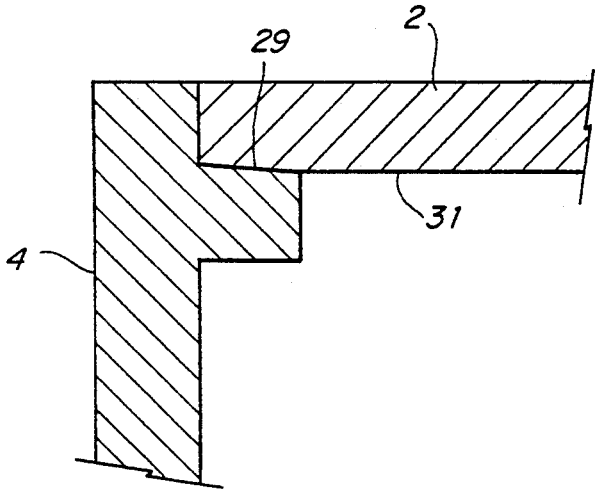
FIG. 4 shows an enlarged detail of a modification of FIG. 3.

The characterizing feature of a compressor according to the invention are partly that the barrel section 2 is produced by extrusion of a suitable material, e.g. aluminium, partly that the projections 29 of the end sections 3, 4 are pressed into barrel section by forced fit. By the extrusion, a simple production of the barrel section blank in selective lengths and a cut is possible for adapting a suitable length for any application. As shown in the drawings one side 28 of the barrel section is plane and in this plane side the outlet openings or ports 19 are cut out, e.g. by milling. Differently from earlier cast compressors, flexibility is obtained with regard to the size of the outlet openings or ports 19 and thus an adaption to the desired compression ratio. The shorter the outlet ports 19 are in the longitudinal directions, the higher is the compression ratio which is obtained. The mason that barrel sections have not earlier been produced by extrusion in spite of these advantages is probably dependent upon the fact that the required stability of the compressor has not been obtained. By combining the extruded barrel section with end sections which are forced into the barrel section by forced fit the required stability and rigidity is obtained. Furthermore, the extrusion process has facilitated a considerably thinner wall thickness resulting in a lower weight of the compressor. Forced fit of the ends 3, 4 into the barrel section 2 has, in the shown embodiment, been obtained by providing the end sections 3, 4 with projections 29 the outer diameter 30 of which is somewhat larger than the inner diameter 31 of the bores 5, 6. In the shown embodiment the surfaces 30, 31 pressed together have straight cylindrical shapes but it is possible to make at least one of those surfaces tapered, as shown in FIG. 4. In FIG. 4, the surface 29 is tapered and the end portion of surface 31 which contacts surface 29 is tapered.

The end 3, 4 sections are preferably produced from the same material as the barrel section 2.

I claim:

1. A screw compressor comprising:

an extruded housing including a barrel section (2) and two end sections (3, 4) at opposite end portions of said barrel section (2);

said housing enclosing a working space, said working space including two intersecting bores (5, 6);

said barrel section (2) having an opening at each opposite end portion thereof;

a pair of intermeshing rotors (7, 8) mounted in said housing, each rotor being mounted in a respective one of said bores, and each rotor having intermeshing helical lands and intervening grooves;

inlet and outlet ports (18, 19) formed in said housing and in communication with respective bores of said working space;

each of said end sections (3, 4) having a projection (29) shaped correspondingly to a respective opening of a transverse section of the opposite end portions of said barrel section (2), and said projections being dimensioned so as to be inserted into respective openings of said barrel section (2) by forced fit between outer surfaces (30) of the projections (29) and inner surfaces (31) of said end portions of said barrel section (2) to improve rigidity of said housing;

wherein at least one of said outer surfaces (30) of said projections (29) and said inner surfaces (31) of said end portions of said barrel section, which are pressed together, is a straight tapered surface; and at least one screw joint (20–22; 25) at each of said end sections (3, 4) for securing said respective end sections (3, 4) to said barrel section (2).

2. A screw compressor according to claim 1, wherein both of said outer surfaces (30) of said projections and said inner surfaces (31) of said end portions of said barrel section, which are pressed together, are straight tapered surfaces.

3. A screw compressor according to claim 2, wherein said end sections (3,4) and said barrel section (2) are made of a same material.

4. A screw compressor according to claim 2, wherein the end sections (3, 4) and said barrel section (2) are made from a metal.

5. A screw compressor according to claim 2, wherein the end sections (3, 4) and said barrel section (2) are made from aluminum.

6. A screw compressor according to claim 2, wherein said inlet port (18) is formed in one of said end sections (3).

7. A screw compressor according to claim 2, wherein:

said barrel section (2) has a plane surface portion (28); and said outlet port (19) is located along a portion of said plane surface portion (28) of said barrel section (2).

8. A screw compressor according to claim 2, wherein outlet port (19) has a length in the longitudinal direction of said barrel section (2) which is a function of a desired internal compression ratio of the screw compressor.

9. A screw compressor according to claim 2, wherein the screw compressor is a supercharger means for supercharging an internal combustion engine.

10. A screw compressor according to claim 1, wherein the end sections (3, 4) and said barrel section (2) are made from a same material.

11. A screw compressor according to claim 1, wherein the end sections (3, 4) and said barrel section (2) are made from a metal.

12. A screw compressor according to claim 1, wherein the end sections (3, 4) and said barrel section (2) are made from aluminum.

13. A screw compressor according to claim 1, wherein said inlet port (18) is formed in one of said end sections (3).

14. A screw compressor according to claim 1, wherein:

said barrel section (2) has a plane surface portion (28); and said outlet port (19) is located along a portion (28) of said plane surface portion (28) of said barrel section (2).

15. A screw compressor according to claim 1, wherein outlet port (19) has a length in the longitudinal direction of said barrel section (2) which is a function of a desired internal compression ratio of the screw compressor.

16. A screw compressor according to claim 1, wherein the screw compressor is a supercharger means for supercharging an internal combustion engine.

* * * * *